US005222445A

United States Patent [19]

Capraro

[11] Patent Number: 5,222,445

[45] Date of Patent: Jun. 29, 1993

[54] AUTOMATIC TELLER MACHINE MAINTENANCE ENCLOSURE

[76] Inventor: Tony Capraro, 178 Pierce St., Staten Island, N.Y. 10304

[21] Appl. No.: 737,156

[22] Filed: Jul. 29, 1991

[51] Int. Cl.[5] ..... G07G 5/00

[52] U.S. Cl. ..... 109/2; 52/79.1; 109/24.1; 109/49.5; 902/34; 902/35

[58] Field of Search ..... 109/2, 24.1, 49.5, 66, 109/69, 70, 73; 52/66, 79.1, 79.5; 902/32, 33, 34, 35

[56] References Cited

U.S. PATENT DOCUMENTS

| | | | |
|---|---|---|---|
| 2,963,122 | 12/1960 | Jagemann | 52/66 |
| 3,629,982 | 12/1971 | Ballay et al. | 52/79.5 X |
| 4,035,964 | 7/1977 | Robinson | 52/66 |
| 4,165,117 | 8/1979 | Kaiser | 52/66 X |
| 4,417,527 | 11/1983 | Williams et al. | 902/34 X |
| 4,497,261 | 2/1985 | Ferris et al. | 109/2 |
| 4,513,670 | 4/1985 | Berman | 109/2 X |
| 4,603,643 | 8/1986 | Couvrette | 109/2 X |
| 4,649,832 | 3/1987 | Hain et al. | 109/24.1 |
| 4,681,044 | 7/1987 | Dallman | 109/24.1 |
| 4,911,087 | 3/1990 | Couvrette | 109/2 X |
| 5,036,779 | 8/1991 | Capraro | 109/2 X |

*Primary Examiner*—Lloyd A. Gall
*Attorney, Agent, or Firm*—Richard L. Miller

[57] ABSTRACT

A maintenance enclosure for an automatic teller machine having an operable front panel and an openable service panel is provided. The enclosure consists of a stationary enclosure about three sides of the automatic teller machine so that the operable front panel can extend through one portion of the stationary enclosure, while the openable service panel can extend into the stationary enclosure. An expandable enclosure is affixed to the open portion of the stationary enclosure to close off the automatic teller machine so that when the automatic teller machine is in use the expandable enclosure is normally folded inwardly towards the stationary enclosure to fit the smallest possible area. A door which opens inwardly is hinged in the expandable enclosure so that when the automatic teller machine is to be repaired the expandable enclosure and the door opened to gain access to the openable service panel. A sliding roof is provided which is normally closed when the expandable enclosure is normally folded inwardly to seal the automatic teller machine therein and is opened when the expandable enclosure is folded outwardly to ventilate the automatic teller machine when being repaired.

4 Claims, 1 Drawing Sheet

AUTOMATIC TELLER MACHINE MAINTENANCE ENCLOSURE

BACKGROUND OF THE INVENTION

1. Field of the Invention

This invention relates to an enclosure for housing an automatic teller machine comprising a pair of folding sections which expand from their closed position to provide a structure sufficiently large to be entered by service personnel, and which takes up minimum room when folded.

2. Description of the Prior Art

Automatic unmanned teller machines are common in today's society. Such machines are commonly located away from the principal banking offices, such as in lobbies, airports, shopping centers or installed in and accessible from an outside wall of a bank building. Most of such machines have 24 hour walk-up or drive-up availability, and the machines must be secure from access by unauthorized persons both from the outside where the automated banking is performed by the public and from the inside where the mechanisms of the machine and usually cash are located.

In addition to availability and security, another factor in the location for such machines is that they take up as little space as possible. When installed on an outside wall of a bank building it is important that the machine be accessible for servicing, but if its security enclosure extends too far into the banking premises, it takes away from room otherwise available for bank workers. When the machine is being serviced it is also necessary that such servicing take place in a secure environment. All these factors are possible if the housing for such machines comprises a pair of folding sections, one of which fits next to the other, with access into the enclosure being possible only when the sections of the enclosure are unfolded.

An expandable security structure for housing an automatic teller machine comprising a pair of telescoping sections that nest together is shown in U.S. Patents to Hastings, U.S. Pat. No. 4,121,523 and the Stine, U.S. Pat. No. 4,244,302, but neither of these references have the simplicity of the present invention.

Numerous other security enclosures have been provided in the prior art that are adapted to enclosure of housings of automated teller machines having electronic computer systems. For example, Ferris et al U.S. Pat. No. 4,497,261; Berman U.S. Pat. Nos. 4,513,670 and 4,577,562; Trucksess U.S. Pat. No. 4,696,239 and to Couvrette U.S. Pat. No. 4,813,475 all are illustrative of such prior art. While these units may be suitable for the particular purpose to which they address, they would not be as suitable for the purpose of the present invention as hereafter described.

SUMMARY OF THE INVENTION

A primary object of the present invention is to provide an automatic teller machine maintenance enclosure that will overcome the shortcomings of the prior art devices.

Another object is to provide an automatic teller machine maintenance enclosure designed to fold inwardly to fit the smallest area possible such as twenty four hour vestibules, supermarkets, shopping malls, corporate office site premises, airports, etc.

An additional object is to provide an automatic teller machine maintenance enclosure designed to fold outwardly to a completely enclosed, secured, cash replenishment and maintenance area to accommodate at least one person.

A still further object of the present invention to provide a secure enclosure for housing an automatic teller machine in which a pair of folding sections expand from a closed position which takes up a minimum of space to an expanded position where access is possible into the enclosure for servicing.

Another object of this invention is an expandable security structure containing an automatic teller machine in which the teller machine is accessible for use by the public but is secure from tampering and theft when in its closed position.

A further object of this invention is an expandable security structure for housing an automatic teller machine in which one portion is easily movable between a closed position for security and an expanded position for servicing.

A yet further object is to provide an automatic teller machine maintenance enclosure that is simple and easy to use.

A still further object is to provide an automatic teller machine maintenance enclosure that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
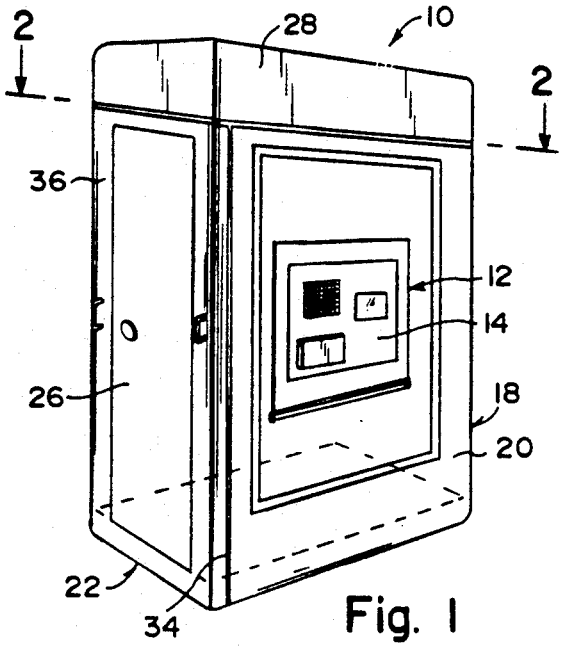
FIG. 1 is a perspective view of the instant invention.

Turning now descriptively to the drawings, in which like reference characters denote like elements throughout the several views, the Figures illustrate a maintenance enclosure 10 for an automatic teller machine 12 having an operable front panel 14 and an openable service panel 16. The enclosure 10 consists of a stationary enclosure 18 about three sides of the automatic teller machine 12 so that the operable front panel 14 can extend through one portion 20 of the stationary enclosure 18, while the openable service panel 16 can extend into the stationary enclosure 18. An expandable enclosure 22 is affixed to the open portion 24 of the stationary enclosure 18 to close off the automatic teller machine 12 so that when the automatic teller machine 12 is in use the expandable enclosure 22 is normally folded inwardly towards the stationary enclosure 18 to fit the smallest possible area. A door 26 which opens inwardly is hinged in the expandable enclosure 22 so that when the automatic teller machine 12 is to be repaired the expandable enclosure 22 is folded outwardly away from the stationary enclosure 18 and the door 26 opened to gain access to the openable service panel 16.

A sliding roof 28 is provided which is normally closed when the expandable enclosure 22 is normally folded inwardly to seal the automatic teller machine 12 therein and is opened when the expandable enclosure 22 is folded outwardly to ventilate the automatic teller machine 12 when being repaired.

The expandable enclosure 22 includes a pair of bifold panels 30, each hinged at 32 to one open end 34 of the stationary enclosure 18. An access panel 36 is hinged at 38 and extends between the bifold panels 30. The access panel 36 has the door 26 hinged thereto so that a person can enter the maintenance enclosure 10 through the door 26 to repair the automatic teller machine 12.

Figure 2:
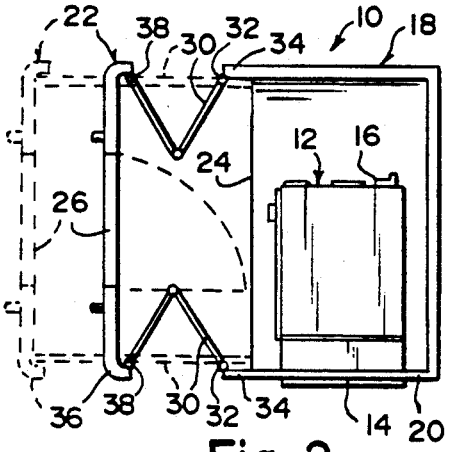
FIG. 2 is a top view with roof assembly removed taken along line 2—2 in FIG. 1, of a side loading embodiment of an automatic teller machine.
Figure 3:
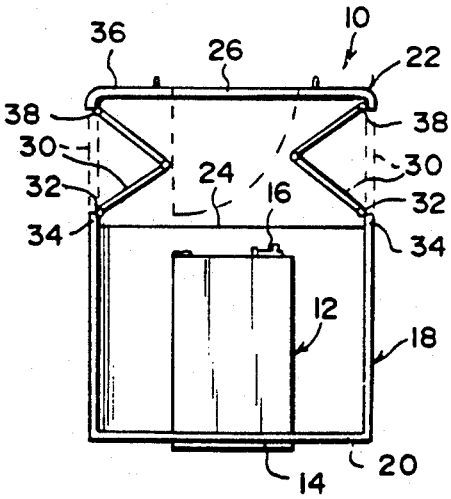
FIG. 3 is a top view similar to FIG. 2 showing a back loading embodiment of the automatic teller machine.
Figure 4:
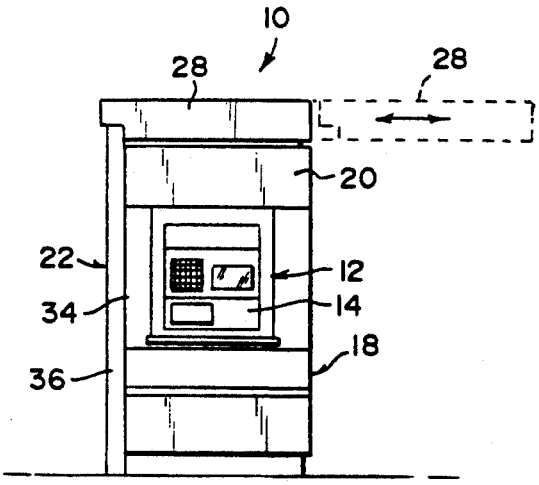
FIG. 4 is a front view illustrating the sliding roof assembly of the instant invention.

As shown in FIGS. 1, 2 and 4, the expandable enclosure 22 is affixed to an open side portion 24 of the stationary enclosure 18, while in FIG. 3, the expandable enclosure 22 is affixed to an open rear portion 24 of the stationary enclosure 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A maintenance enclosure for an automatic teller machine having an operable front panel and an openable service panel, said enclosure comprising:

a) a stationary enclosure about three sides of the automatic teller machine and having an open portion at a fourth side of the machine so that the operable front panel can extend through one portion of said stationary enclosure, while the openable service panel can extend into said stationary enclosure; and b) an expandable enclosure affixed to the open portion of said stationary enclosure to close off the automatic teller machine and including a pair of bifold panels, each hinged to a respective end defining said open portion of said stationary enclosure and an access panel hinged to and extending between said bifold panels, said access panel having an inwardly opening door hinged thereto so that when the automatic teller machine is in use said expandable enclosure is normally folded inwardly towards said stationary enclosure by folding the panels of said pair of bifold panels together with the door closed to fit the smallest possible area, so that when the automatic teller machine is to be repaired said expandable enclosure is folded outwardly away from said stationary enclosure by unfolding the panels of said pair of bifold panels apart and said door opened inwardly to gain access to the openable service panel so that a person can enter said maintenance enclosure through said door to repair the automatic teller machine.

2. A maintenance enclosure as recited in claim 1, further including a sliding roof which is normally closed when said expandable enclosure is normally folded inwardly to seal off the automatic teller machine therein and is opened when said expandable enclosure is folded outwardly to ventilate the automatic teller machine when being repaired.

3. A maintenance enclosure as recited in claim 2, wherein said expandable enclosure is affixed to an open side portion of said stationary enclosure.

4. A maintenance enclosure as recited in claim 2, wherein said expandable enclosure is affixed to an open rear portion of said stationary enclosure.

* * * * *